United States Patent [19]

Ishige et al.

[11] Patent Number: 4,838,438

[45] Date of Patent: Jun. 13, 1989

[54] CRANE AND DRIVING SYSTEM THEREFOR

[75] Inventors: Ryohei Ishige, Hikari; Kazuo Hatakeyama, Kudamatsu, both of Japan

[73] Assignee: Hitachi, Ltd., Tokyo, Japan

[21] Appl. No.: 53,482

[22] Filed: May 26, 1987

Related U.S. Application Data

[63] Continuation of Ser. No. 638,422, Aug. 7, 1984, abandoned.

[30] Foreign Application Priority Data

Aug. 8, 1983 [JP] Japan ..... 58-143875

[51] Int. Cl.[4] ..... B66C 13/26

[52] U.S. Cl. ..... 212/159; 212/205; 212/209; 212/218

[58] Field of Search ..... 212/159, 217, 126, 131, 212/205, 218, 219; 180/53.5, 65.4; 318/801; 254/292, 294, 299, 327

[56] References Cited

U.S. PATENT DOCUMENTS

| | | | |
|---|---|---|---|
| 1,585,351 | 5/1926 | Ionides | 180/65.4 |
| 2,596,343 | 5/1952 | Spafford | 212/159 |
| 2,822,929 | 2/1958 | Kruzic | 212/159 |
| 3,009,583 | 11/1961 | Pierson | 212/217 |
| 3,081,883 | 3/1963 | Minty | 212/209 |
| 3,788,606 | 1/1974 | Solter | 254/299 |
| 4,372,725 | 2/1983 | Moore et al. | 414/460 |
| 4,516,664 | 5/1985 | Anzai et al. | 318/801 |

FOREIGN PATENT DOCUMENTS

| | | | |
|---|---|---|---|
| 3231959 | 3/1984 | Fed. Rep. of Germany | 180/65.4 |
| 711693 | 7/1954 | United Kingdom | 254/292 |

*Primary Examiner*—Sherman D. Basinger
*Assistant Examiner*—Thomas J. Brahan
*Attorney, Agent, or Firm*—Antonelli, Terry & Wands

[57] ABSTRACT

A crane provided with traveling wheels disposed under a crane frame. The crane includes a hoisting accessory which is adapted to be hoisted by a hoist apparatus. AC motors are provided as travel motors for driving the traveling wheels as well as hoist motors for driving the hoist apparatus. The crane is equipped with a DC power source generating DC power, inverter units converting the DC power into AC power and outputting the AC power, and a change-over or switching arrangement for supplying the AC power to the travel motors when the crane is being moved and to the hoist motors during a hoisting operation of the hoisting accessory.

1 Claim, 3 Drawing Sheets

CRANE AND DRIVING SYSTEM THEREFOR

This is a continuation Ser. No. 638,422 , filed Aug. 7, 1984 now abandoned.

BACKGROUND OF THE INVENTION

The present invention relates to a crane construction and, more particularly, to a transfer crane and driving system therefor.

Cranes are generally provided with traveling wheels in legs formed by frame members and, typically, transfer cranes are provided with traveling wheels generally having rubber tires.

In a crane of the aforementioned type, a crane frame includes a pair of girders, four leg members supporting the girders, right and left saddle members supporting the leg members, and rubber-tired wheels provided at lower parts of the crane frame in such a manner that the weight of the entire crane is usually supported by four rubber tires. Two of the four rubber-tired wheels, located on either side of the crane, are provided with drive or travel motors for dirving the wheels, with the crane being moved by transmission of a rotational power of the drive or travel motor to the rubber-tired wheels. When moving, the right and left travel motors are simultaneously driven and the crane moves along a predetermined path. If the crane deviates from the predetermined path, the speeds of the right and left travel motors are controlled to return the crane to the predetermined path by a so-called positional or steering control. The control of the speed of the drive travel motors to enable the positional or steering control must be very precise and a wide speed control range is essential; therefore, DC motors are used as the travel or drive motors, and a Leonard control system is adopted for the speed control.

A trolley is generally mounted on the girders of the crane, with the trolley being adapted to be moved transversely along the girders by a traverse drive motor. A hoisting accessory such as, for example, a spreader is suspended by the trolley by cables or ropes, with the spreader being adapted to be hoisted up and down by hoist devices which, for example, comprise a drum about which a cable or rope is wound, a hoist motor for driving the drum, and other units. Transfer cranes of the aforementioned type are disclosed, for example, in U.S. Pat. Nos. 4,329,632 and 4,424,875.

As apparent from the above description, a transfer crane is usually provided with at least two DC travel motors, at least one traverse DC motor, and at least one hoist motor which may either be an AC or a DC motor and, by virtue of this fact, a considerable number of controlling devices for the drive motors as well as the power sources, usually generators for supplying power to the motors, are required. Therefore, the entire crane is very large resulting in difficulties in maintenance and inspection thereof in addition to a very high production cost.

The aim underlying the present invention essentially resides in providing a crane and driving system therefor wherein the driving elements of the driving system are of a simplified construction while not in any way effectng or reducing the overall functioning of the crane but which nevertheless enables an easy maintenance and inspection.

In accordance with advantageous features of the present invention, a crane is provided which is equippd with a crane frame having traveling wheels, with one or more AC hoist motors driving a hoist apparatus mounted on the crane frame. One or more AC travel motors are provided for driving the traveling wheels, with a power source generating DC power. At least one inverter unit is provided with the inverter unit inputting the DC power and converting the same into an AC power of a frequency corresponding to a speed instruction and outputting AC power. A switching means is provided selectively supplying the AC power from the at least one inverter unit either to the AC hoist motor or to the AC travel motors.

Advantageously, in accordance with further features of the present invention, the power from the at least one inverter unit is solely supplied to the travel motors during traveling and solely to the hoist motors during the hoisting of an object.

Preferably, according to the present invention, the AC hoist and AC travel motors are induction motors, and the power source is a DC generator driven by, for example, an engine.

One of the AC travel motors is advantageously installed on each side of the crane for driving the traveling wheels provided on the corresonding side of the crane, with the frequencies of the Ac power signal to each of the AC travel motors being altered to effect positional control.

In accordance with yet further features of the present invention, two AC hoist motors are provided, with an electrical magnetic clutch means being provided for selectively driving the AC hoist motors independently or together.

According to the present invention, two inverter units may be provided, with the change over or switch means supplying the AC power output by each of the two inverter units to the travel motor on the corresponding side of the crane when the crane is operated so as to move the same, with the AC power output by each of the inverter units being supplied to the corresponding AC hoist motor when the hoist apparatus is operated.

Traveling wheels are mounted on leg members of the crane frame, with an trolley also being mounted on the crane frame along with a AC traverse motor driving the trolley. The hoist apparatus is provided with hoisting accessories and is vertically movable by the motion of the hoist apparatus. The change over or switch means supplies the AC power to the AC travel motors when the crane is operated so as to move the same, while supplying the AC power to the AC hoist motors when the hoisting apparatus is operated. Inverter units, for converting the DC power into AC power, are controlled so as to alter the frequency of the AC power.

As apparent from the above described features of the present invention, a crane driving system is realized wherein the travel motors for moving the crane and the hoist motors driving the hoisting apparatus provided on the crane are all AC motors, with the motors having common inverter units for converting DC power into AC power, with the AC power being supplied only to the travel motors when the crane is moved and only to the hoist motors when the hoisting apparatus is driven.

It is an object of the present invention to provide a crane and driving system therefor which avoids, by simple means, shortcomings and disadvantages encountered in the prior art.

Another object of the present invention resides in providing a crane and drive system which is simple in construction and therefore relatively inexpensive to manufacture.

Yet another object of the present invention resides in providing a crane drive system therefor which is easy to maintain and inspect.

A still further object of the present invention resides in providing a crane and drive system therefor which functions realiably under all operating conditions.

These and other objects, features, and advantages of the present invention will become more apparent from the following description when taken in connection with the accompanying drawings which show, for the purposes of illustration, one embodiment in accordance with the present invention.

DETAILED DESCRIPTION

Figure 1:
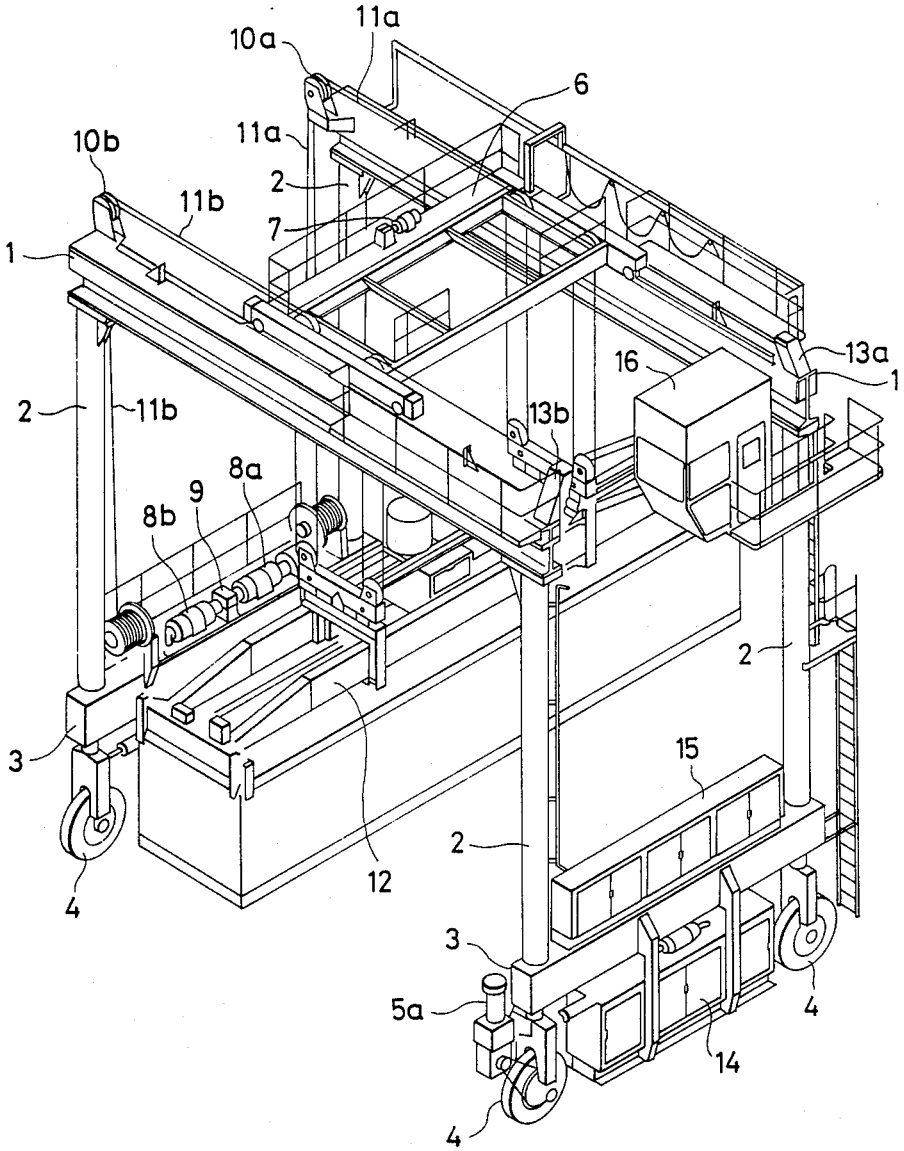
FIG. 1 is a perspective view of a crane constructed in accordance with the present invention.

Referring now to the drawings wherein like reference numerals are used throughout the various views to designate like parts and, more particularly, to FIG. 1, according to this figure, a crane includes a pair of girders 1, four leg members 2 supporting the girders 1, saddle beams 3, traveling wheels 4 provided for each of the leg members 2, and travel motors 5*a*, 5*b* for driving the traveling wheels 4. One travel motor is provided on each side of the crane, however, the travel motor 5*b* is not shown in FIG. 1 since it is positioned behind the othr units of the crane. A trolley 6 is adpated to move transversely along the girders 1 and is driven by a traverse motor 7. Hoist devices 8*a*, 8*b* are connected by a magnetic clutch 9. Sheaves 10*a*, 10*b* are mounted on the girders 1, with cables or ropes 11*a*, 11*b* being disposed about the sheaves 10*a*, 10*b*, respectively. A spreader 12 is suspended from the trolley 4 by the ropes or cables 11*a*, 11*b*, with the spreader 12 being adapted to be hoisted up and down by driving the hoist devices 8*a*, 8*b* so that the hoist devices wind or unwind the ropes or cables 11*a*, 11*b*. The ends of the ropes 11*a*, 11*b* are respectively fixed at rope or cable fixing means 13*a*, 13*b*, and a power system 14 such as, for example, an engine generator is provided, with a control panel 15 accommodating control equipment for the crane. An operators cabin 16 accommodates operating equipment whereby the operator can provide output control instructions to the control equipment in the control panel and thus operate the crane.

Figure 2:
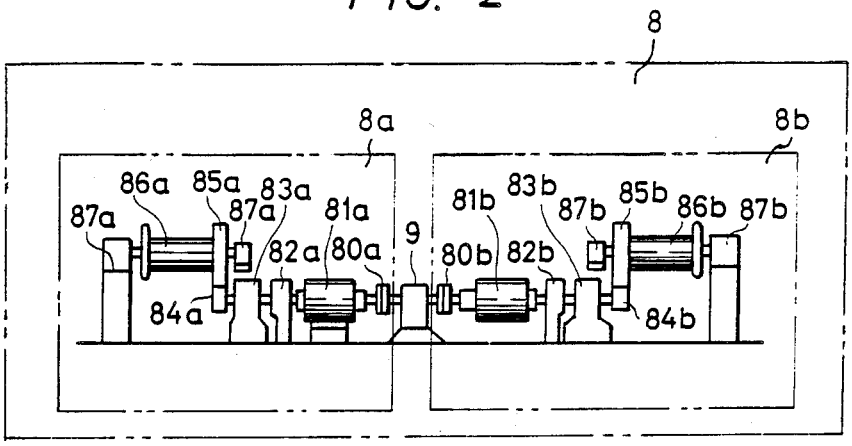
FIG. 2 is a detail view of units of a hoist device of a crane constructed in accordance with the present invention.

As shown in FIG. 2, the hoist devices 8*a*, 8*b* include couplings 80*a*, 80*b*, hoist motors 81*a*, 81*b*, brakes 82*a*, 82*b*, reduction gears 83*a*, 83*b*, pinions 84*a*, 84*b*, drum gears 85*a*, 85*b*, drums 86*a*, 86*b* and frames 87*a*, 87*b* supporting the drums 86*a*, 86*b*. In the illustrated embodiment, the hoist device 8*a*, includes the components 80*a*–87*a*, and the hoist device 8*b* includes the components 80*b*–*87b*, and an electromagnetic clutch connects the hoist devices 8*a*, 8*b*.

When the hoist motors 81*a*, 81*b* are operated by a beam connected to the electromagnetic clutch 9, the winding drums 86*a*, 86*b* rotate in the same direction and, when the electromagnetic clutch 9 is disconnected so that only the motor 81*a* operates, the drum 86*a* winds or unwinds the rope 11*a* so as to enable a tilting of the spreader 12. As can readily be appreciated, the spreader 12 can be similarily tilted by only operating the motor 81*b*. When the electromagnetic clutch 9 is connected to drive the motors 81*a*, 81*b* with the spreader 12 left in a tilted condition, the spreader 12 moves vertically in the tilted state, with the tilting being very useful since the tilting increases the freedom of movements that can be employed when the crane carries a load. The effect of the division of the hoist apparatus into two hoist devices 8*a*, 8*b* lies not only in the fact that the operating functions art thereby increased but also in the fact that it is possible for a selective employment of inverter units for traveling of the crane or for operation of the hoist devices 8*a*, 8*b* and, consequently, it plays a large roll in simplifying the construction of the crane.

Figure 3:
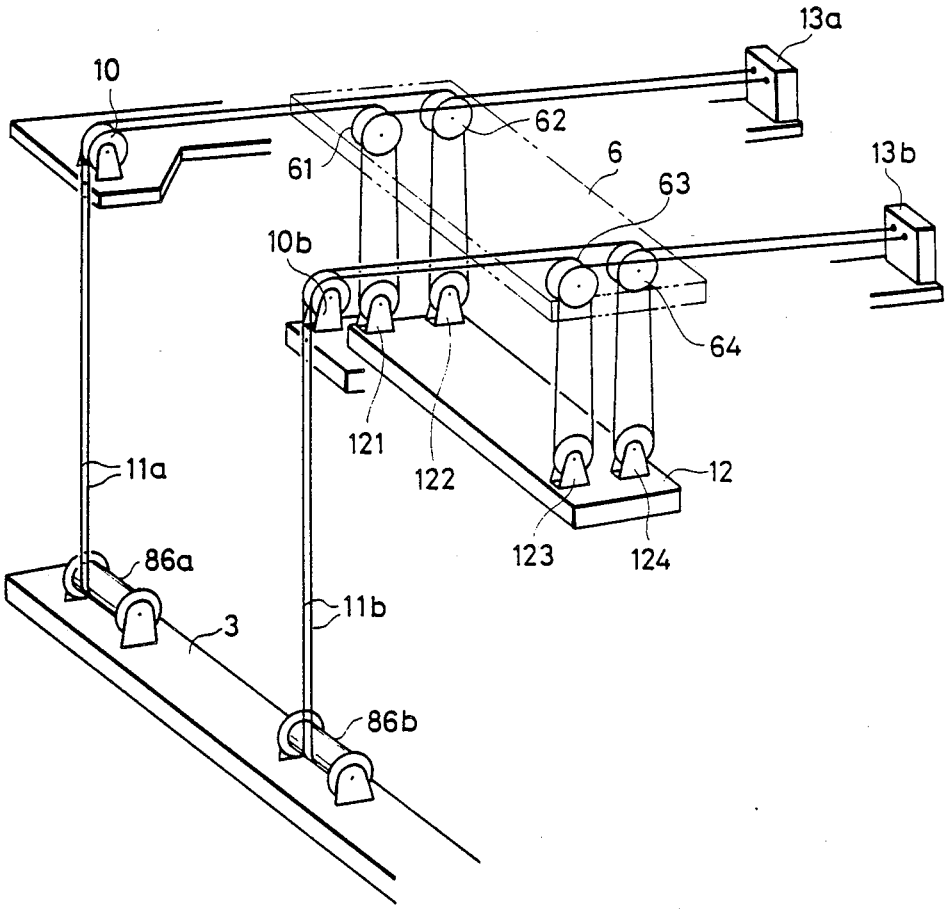
FIG. 3 is a schematic illustration of an arrangement of ropes or cables in the crane of FIG. 1.
Figure 4:
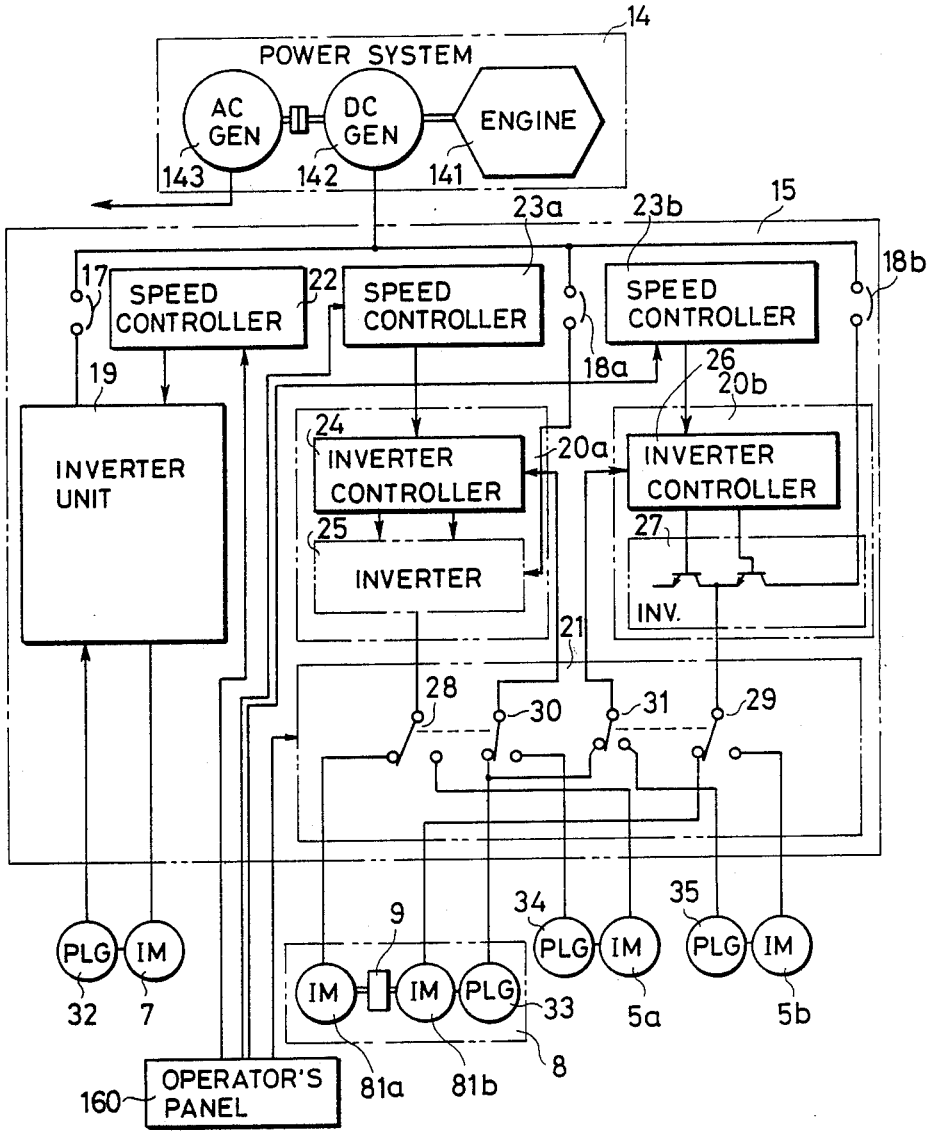
FIG. 4 is a block diagram of a driving system and control arrangement of a crane constructed in accordance with the present invention.

As shown in FIG. 3, the sheaves 10*a*, 10*b* are provided at one end of each girder 1, with the ends of the ropes or cables 11*a*, 11*b* being connected to the rope or cable fixing means 13*a*, 13*b* provided at the other ends of the respective girders 1. Sheaves 61–64 are attached to the trolley 6, with sheaves 121–124 being attached to the spreader 12. One of the ropes or cables 11*a*, extending from the drum 86*a* of the hoist device 8*a* passes through the sheaves 10*a*, 61, 121 and 61 and is attached to the rope or cable fixing means 13*a*, with the other of the ropes or cables 11*a* passing through or around the sheaves 10*a*, 62, 122, and 62 and being attached to the rope or cable end fixing means 13*a*. One of the ropes or cables 11*b* extends from the drum 86*b* of the hoist device 8*b*, passes through or around the sheaves 10*b*, 63, 123 and 63 and is attached to the rope or cable end fixing means 13*b*, while the other of the ropes or cables 11*b* passes through or around sheaves 10*b*, 64, 124 and 64 and is also attached to the rope or cable end fixing means 13*b*. As shown in FIG. 4, the power system 14 of FIG. 1 includes an engine 141, a DC generator 142 driven by the engine, and an AC generator 143. Pulse generators 32–35 are provided for respectively generating pulses corresponding to the speed of the associated travel motor 7, hoist motors 81*a*, 81*b*, and travel motors 5*a*, 5all of which are constructed as induction generator. The DC motor 142 is provided for supplying power to the travel motors 5*a*, 5*b*, the hoist motors 81*a*, 81*b* and the traverse motor 7. The AC generator 143 is used as a power source for lighting equipment and operating uits of the crane. The control panel 15 of FIG. 1 is provided with switches 17, 18*a*, 18*b*, inverter units 19, 20*a*, 20*b*, respectively supplied with power through the switches 17, 18*a*, 18*b*, a change-over means 21 for selectively supplying outputs of the inverter units 20*a*, 20*b* to the motors in accordance with the selection signals, and speed controllers 22, 23*a*, 23*b* for receiving speed instructions as inputs and outputs speed control signals to the inverter units 19, 20*a*, 20*b*, respectively. The inverter units 19, 20*a*, 20*b* have the same structure and each inputs an DC power, converts the inputted DC power into a AC power of a frequency corresponding to a speed instruction, and outputs this power. More specifically, a speed control signal and a speed detection signal are inputted to an inverter controller within each of the inverter units 19, 20*a*, 20*b*, with the inverter controllers 24, 26 supplying the inverters 25, 27 with a control signal corresponding to the input signals, and the inverters 25, 27 generating AC power of a desired frequency. The internal structure of the inverter unit 19 is the same as the other inverter units 20*a*, 20*b* and for the sake of clarity, has been omitted from FIG. 4. The change-over or switch means 21 changes the supply of AC power generated by the inverter units 20*a*, 20*b* to the travel motors 5*a*, 5*b* or to the hoist motors 81*a*, 81*b*. Switches 28, 29 are provided for switching the power supply, with switches 30, 31 being provided for feeding back the speed detection signal of each motor according to the switching of the power supply. An operators panel 160 is provided in the operators cabin 16, with the panel 160 providing output control instructions such as, for example, speed instructions, selection signals, etc.

A crane having the above-described construction operates in the following manner:

At the start of operation, the operator first pushes a start button in the operator's panel 160 to start the engine 141. This action results in a starting of the DC generator 142 and the AC generaor 143 which generate their respective power. In order to make the crane move, the operator outputs a selection signal corresponding to a desired movement state through the operator's panel 160. Based on this selection signal, the change-over or switch means 21 switches the switches to the side at which AC power is supplied to the travel motors 5*a*, 5*b*. When speed instructions are subsequently outputted from the operator's panel 160, speed control signals are outputted from each of the speed controllers 23*a*, 23*b* resulting in the inverter units 20*a*, 20*b* generating AC power of frequencies corresponding to the speed instruction. The AC power is supplied to the motors 5*a*, 5*b* through the change-over or switch means 21 so that the motors 5*a*, 5*b* are subjected to a frequency speed control. This operational movement of the crane continues until the crane arrives at its desired destination. The positional control of the crane during the travel thereof can be effected by altering the frequencies of the AC power generated by each of the inverter units 20*a*, 20*b*. In other words, the speed control signals can be altered by adjusting the speed instructions themselves or by inputting a signal for correcting the positioning of the crane to each of the speed controllers 23*a*, 23*b*, in addition to the speed instruction, and the inverter units 19, 20*a*, 20*b* each generate AC power of a frequency corresponding to the relevant speed control signal. Thus, a difference in speed occurs between the motors 5*a*, 5*b* which enables a positional control.

The hoist apparatus for hoisting and lowering the spreader 12 operates in the following manner:

When a selection signal corresponding to the state of operation of the hoist apparatus is outputted from the operator's panel 160, the change-over or switch means 21 is switched to the side at which the AC power generated by each of the inverter units 20*a*, 20*b* is supplied to the corresonding motors 81*a*, 81*b*. When a subsequent hoisting up or lowering speed instruction is outputted from the panel 160, speed control signals are outputted from the speed controllers 23*a*, 23*b*, and each of the inverter units 20*a*, 20*b* generates AC power of a frequency corresponding to the speed instruction. The AC power is supplied to the corresponding motors 81*a*, 81*b* through the change-over or switch means 21 to drive the hoist apparatus 8 and hoist or lower the spreader 12.

A transverse movement of the trolley 4 is effected by a speed instruction outputted from the operator's panel 160. More particularly, the speed instruction is inputted to the speed controller 22, with the corresponding inverter unit 19 generating a AC power of a frequency corresponding to the speed instruction, with the AC power being supplied to the traverse motor 7 to drive the trollery 4.

In the above-described crane construction, the induction motors are employed as travel motors 5*a*, 5*b* and hoist motors 81*a*, 81*b* and frequency control by inverters is employed for driving the motors 5*a*, 5*b* and 81*a*, 81*b*. The number of travel motors is the same as the number of hoist motors and the inverter units are employed in such a manner that they are switched from traveling to the operation of the hoist apparatus and vice versa. Consequently, with a construction such as proposed by the present invention, the number of inverter units can be reduced. Additionally, the power sources for driving the travel motors 5*a*, 5*b*, hoist motors 81*a*, 81*b* and traverse motor 7 are obtained from one DC generator. As can readily be appreciated, by virtue of the constructional features proposed by the present invention, it is possible for the structure of the crane to be simplified and, in particular, a simplification in the electrical equipment and the control units thereby facilitating the maintenance and inspection of the crane as well as greatly reducing the overall cost of the crane.

Consequently, according to the present invention, the travel motors 5*a*, 5*b*and hoist motors 81*a*, 81*b* are all induction motors which use common power sources switched according to the mode of the inverter units and, as a result thereof, the structure of the driving elements of the crane is simplified thereby simplifying maintenance and inspection thereof as well as reducing the overall cost of the crane.

While we have shown and described several embodiments in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

We claim:

1. A steerable crane comprising a crane frame, traveling wheels having rubber tires mounted on respective sides of said crane frame for steerable travelling of the crane, at least one AC hoist motor means for driving a hoist apparatus mounted on said crane frame, at least one AC travel motor means for driving said traveling wheels, a DC generator driven by an engine for generating DC power, at least one inverter means for receiving the DC power and converting the DC power into an AC power of a frequency corresponding to a speed instruction, and for outputting said AC power, and switch means for supplying the AC power from at least said one inverter means, either to said hoist motor means, or to said travel motor means, whereby one motor means is inoperative while the other motor means is operative.

* * * * *